US007683876B2

(12) United States Patent
Chung

(10) Patent No.: US 7,683,876 B2
(45) Date of Patent: Mar. 23, 2010

(54) TIME DIVISION DRIVING METHOD AND SOURCE DRIVER FOR FLAT PANEL DISPLAY

(75) Inventor: Kyu-Young Chung, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 909 days.

(21) Appl. No.: 11/226,621

(22) Filed: Sep. 14, 2005

(65) Prior Publication Data

US 2006/0055656 A1 Mar. 16, 2006

(30) Foreign Application Priority Data

Sep. 14, 2004 (KR) ..... 10-2004-0073376

(51) Int. Cl.
*G09G 3/36* (2006.01)

(52) U.S. Cl. ..... 345/100; 345/99; 345/98

(58) Field of Classification Search ..... 345/98, 345/99, 100, 204
See application file for complete search history.

(56) References Cited

U.S. PATENT DOCUMENTS 6,097,362 A * 8/2000 Kim ..... 345/87
6,611,261 B1 * 8/2003 Zhang et al. ..... 345/204
6,806,854 B2 * 10/2004 Cairns et al. ..... 345/87
7,034,276 B2 * 4/2006 Morita ..... 250/214 R
7,151,520 B2 * 12/2006 Maki ..... 345/99
7,154,488 B2 * 12/2006 Morita ..... 345/204
7,193,602 B2 * 3/2007 Morita ..... 345/100
7,268,764 B2 * 9/2007 Song et al. ..... 345/100
2003/0132907 A1 * 7/2003 Lee et al. ..... 345/98
2003/0146909 A1 * 8/2003 Maki ..... 345/204
2004/0104873 A1 * 6/2004 Kang et al. ..... 345/87

FOREIGN PATENT DOCUMENTS

| | | |
|---|---|---|
| JP | 5692573 | 1/1981 |
| JP | 61223791 | 10/1986 |
| JP | 04322216 | 11/1992 |
| JP | 06138851 | 5/1994 |
| JP | 08234237 | 9/1996 |
| JP | 11327518 | 11/1999 |
| JP | 0039872 | 2/2000 |
| JP | 2001134245 | 5/2001 |
| KR | 19980083732 | 12/1998 |
| KR | 20020003810 | 1/2002 |
| KR | 20030029479 | 4/2003 |

* cited by examiner

*Primary Examiner*—Richard Hjerpe
*Assistant Examiner*—Gregory J Tryder
(74) *Attorney, Agent, or Firm*—F. Chau & Associates, LLC

(57) ABSTRACT

A source driver and method of driving a flat panel display is provided. As a circuit unit including a multiplexer and a channel selection unit, a source driver performs a single operation to drive one source line in a segment of a horizontal scan period and repeats the single operation multiple times to drive a plurality of source lines in the horizontal scan period.

8 Claims, 6 Drawing Sheets

TIME DIVISION DRIVING METHOD AND SOURCE DRIVER FOR FLAT PANEL DISPLAY

CROSS-REFERENCE TO RELATED APPLICATION

This application claims the priority of Korean Patent Application No. 10-2004-0073376, filed on Sep. 14, 2004, in the Korean Intellectual Property Office, the disclosure of which is incorporated by reference herein in its entirety.

BACKGROUND OF THE INVENTION

1. Field of the Invention

The present invention relates to a flat panel display, and more particularly, to a source driver and method of driving a source line in a flat panel display.

2. Description of the Related Art

Flat panel displays include a thin film transistor (TFT) liquid crystal display (LCD), an electro-luminance flat panel display, a super twisted nematic (STN) LCD, a plasma display panel, and the like. Among these, the TFT LCD, is presently the most widely used.

FIG. 1 is a block diagram of a TFT LCD panel and its peripheral circuits. The TFT LCD panel 110 includes upper and lower plates to which a plurality of electrodes are provided to generate electric fields, a liquid crystal layer interposed between the upper and lower plates, and polarization plates attached on the upper and lower plates. The brightness of the TFT LCD 100 is adjusted by applying voltages corresponding to the gray levels to the pixel electrodes to rearrange the liquid crystal molecules. On the lower plate is disposed a plurality of switching devices such as thin film transistors (TFTs) connected to the pixel electrodes to switch the gray voltage levels. The brightness of a pixel is adjusted by using the switching devices. The three colors red (R), green (G), and blue (B) are represented by using a color filter array provided to the pixels as shown in FIG. 2.

The TFT LCD 100 includes driver circuits having gate drivers 120 disposed on a LCD panel 110 in the horizontal direction to drive a plurality of gate lines and source drivers 130 disposed on the LCD panel 110 in the vertical direction to drive a plurality of source lines and a controller (not shown) for controlling the gate and source driver circuits 120 and 130 to apply the gray voltage levels to the pixel electrodes through switching devices. In general, the controller and the gate and source driver circuits 120 and 130 may be disposed outside of the LCD panel 110. However, in the chip on glass (COG) type, the gate and source driver circuits 120 and 130 may be disposed on the LCD panel 110.

FIG. 3 is a block diagram of a conventional source driver 130. The conventional source driver 130 includes an inversion circuit 131, a latch circuit 132, a gamma decoder 133, and a buffer 134. The block diagram of FIG. 3 shows a circuit unit for driving one source line. To drive a plurality of source lines, a plurality of the circuit units shown in FIG. 3 equal to the number of source lines may be provided. The inversion circuit 131, which receives n-bit (6-bit or 8-bit) image data, has a function of selectively inverting the image data. Image data received by the inversion circuit 131 is digital data obtained by processing the three-color signals, that is, R, G. and B data transmitted externally from a graphics card in accordance with the resolution of the LCD panel 110 by the controller. The latch circuit 132 updates its data with the data newly received from the inversion circuit 131. The gamma decoder 133 selects one of $2^n$ analog gray voltages corresponding to the output digital value of the latch circuit 132. The analog image signal output from the gamma decoder 133 is buffered by the buffer 134 and output to the source line. The source line and the corresponding pixel on the LCD panel 110 are rapidly charged with the image signal output from the buffer 134. The pixel input with the image signal adjusts the brightness by rearranging the liquid crystal molecules in response to the corresponding gray voltage levels.

As the resolution of the LCD panel 110 increases, the number of source lines driven by the source drivers 130 increases in proportion to the resolution. In a case where a high resolution LCD panel 110 is driven by conventional source drivers 130, the number of chips of the source drivers 130 must increase in proportion to the resolution. As a result, the production costs of a large-sized high-resolution LCD panel greatly increase and the productivity thereof decreases.

SUMMARY OF THE INVENTION

According to an aspect of the present invention, there is provided a source driver for driving a flat panel display, comprising: a multiplexer selecting image data in response to channel selection signals; an inversion circuit selectively inverting output data of the multiplexer in response to an inversion drive control signal; a latch circuit storing output data of the inversion circuit and outputting the stored data in response to a latch control signal; a gamma decoder, receiving a plurality of analog voltages the number of which is determined based on the number of bits of image data, and selecting one of the analog voltages in response to output data of the latch circuit; a buffer buffering the selected analog voltage; and a channel section unit outputting the buffered analog voltage to one of a plurality of channels in response to the channel selection signals, wherein each of the buffered analog voltages corresponding to the image data is output to the corresponding channel in one horizontal scan period.

According to another aspect of the present invention, there is provided a source driver for driving a flat panel display, comprising: a plurality of inversion circuits, each of the inversion circuits receiving image data and selectively inverting the received image data in response to an inversion drive control signal; a plurality of latch circuits, each of the latch circuits storing output data of each of the inversion circuits and outputting the stored data in response to a latch control signal; a multiplexer selecting the output data of the latch circuits in response to channel selection signals; a gamma decoder, receiving a plurality of analog voltages the number of which is determined based on the number of bits of image data, and selecting one of the analog voltages in response to output data of the multiplexer; a buffer buffering the selected analog voltage; and a channel section unit outputting the buffered analog voltage to one of a plurality of channels in response to the channel selection signals, wherein each of the buffered analog voltages corresponding to the image data is output to the corresponding channel in one horizontal scan period.

According to still another aspect of the present invention, there is provided a method of driving a flat panel display, comprising: receiving image data; selecting image data in response to channel selection signals; receiving analog voltages; selecting analog voltages corresponding to the image data; and outputting the analog voltages to channels in response to the channel selection signals, wherein the analog voltages corresponding to the image data are output to the corresponding channel in one horizontal scan period, and wherein the channels drive the corresponding source lines of the flat panel display.

BRIEF DESCRIPTION OF THE DRAWINGS

The above and other features of the present invention will become more apparent by describing in detail exemplary embodiments thereof with reference to the attached drawings in which.

DETAILED DESCRIPTION OF THE PREFERRED EMBODIMENTS

Figure 1:
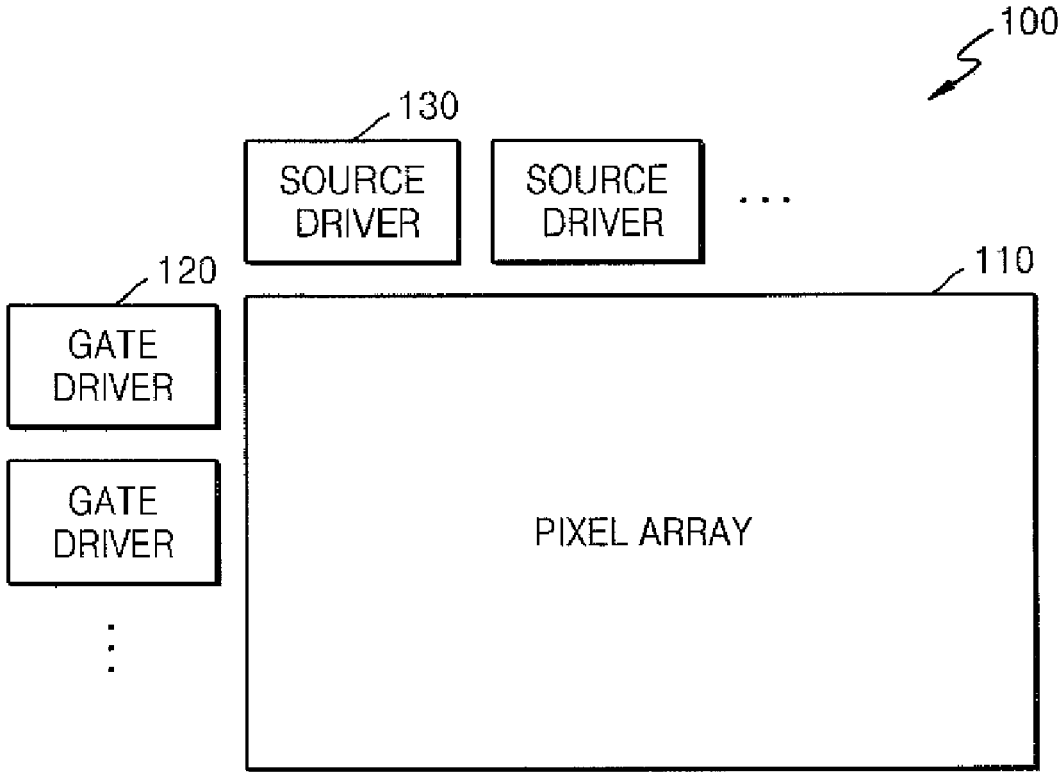
FIG. 1 (PRIOR ART)
FIG. 1 is a block diagram of a TFT LCD panel and its peripheral circuits.
Figure 2:
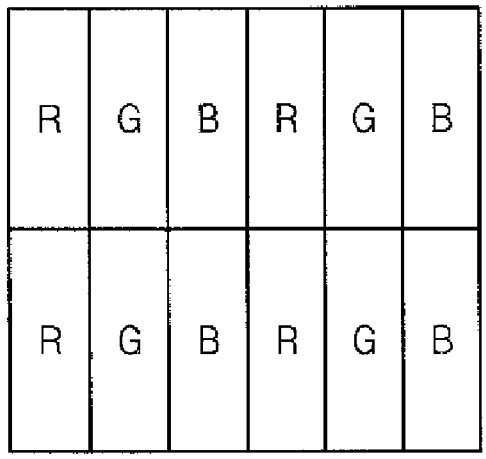
FIG. 2 (PRIOR ART)
FIG. 2 shows a structure of pixels.
Figure 3:
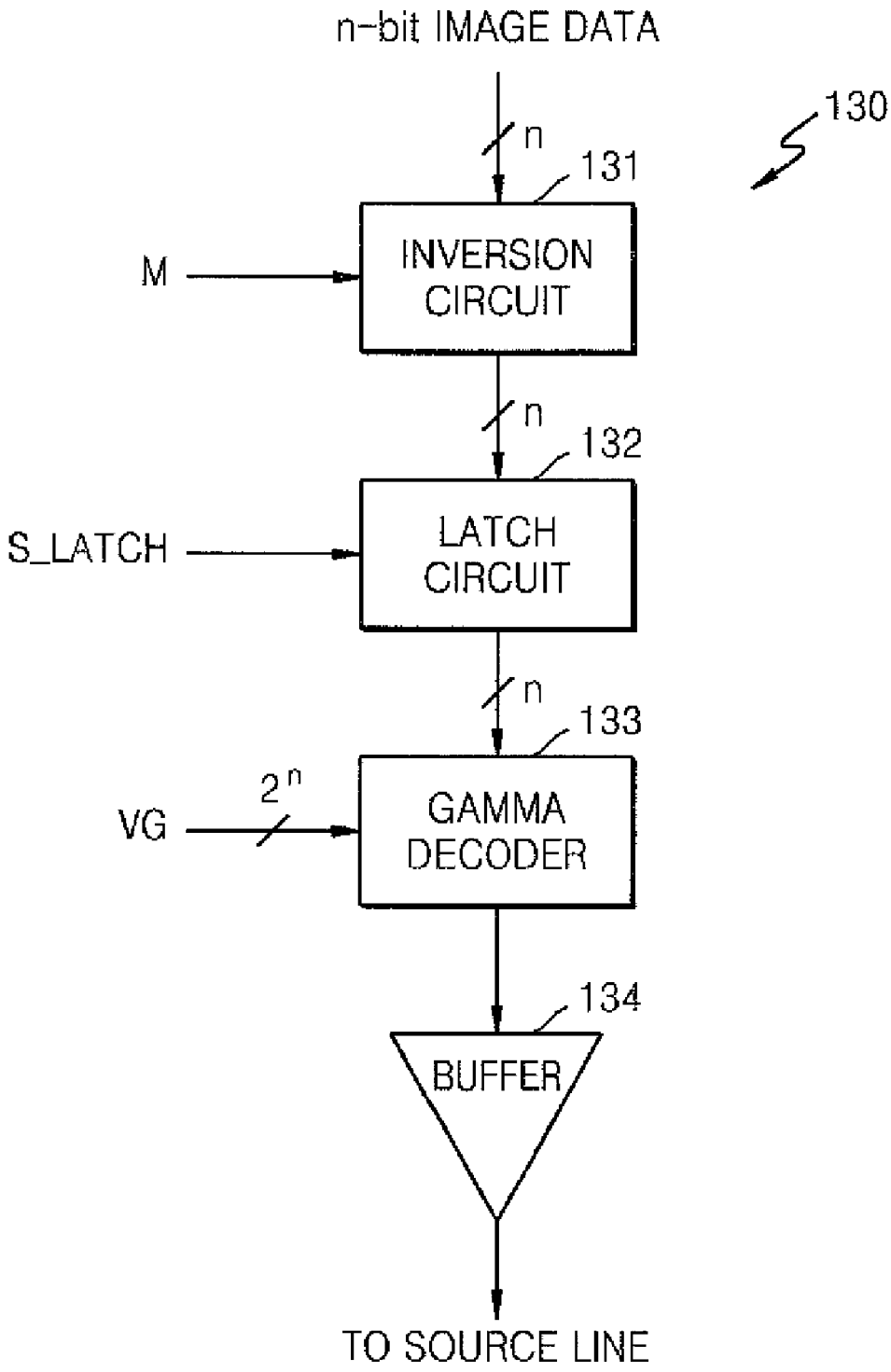
FIG. 3 (PRIOR ART)
FIG. 3 is a block diagram of a conventional source driver.

The present invention will be described in detail by the use of exemplary embodiments of the invention with reference to the attached drawings. Like reference numerals in the drawings denote like elements.

Figure 4:
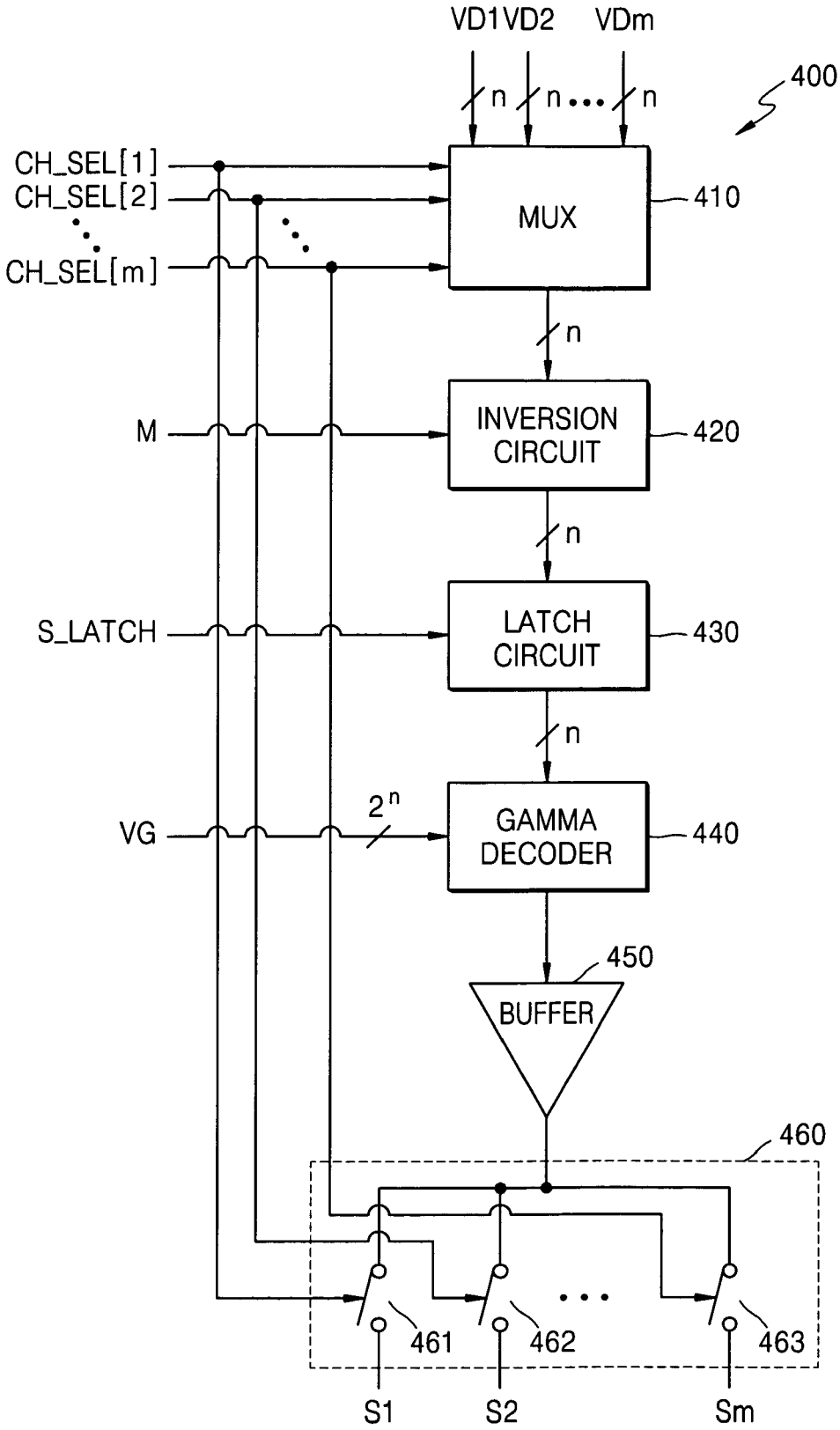
FIG. 4 is a block diagram of a source driver according to an exemplary embodiment of the present invention.
Figure 5:
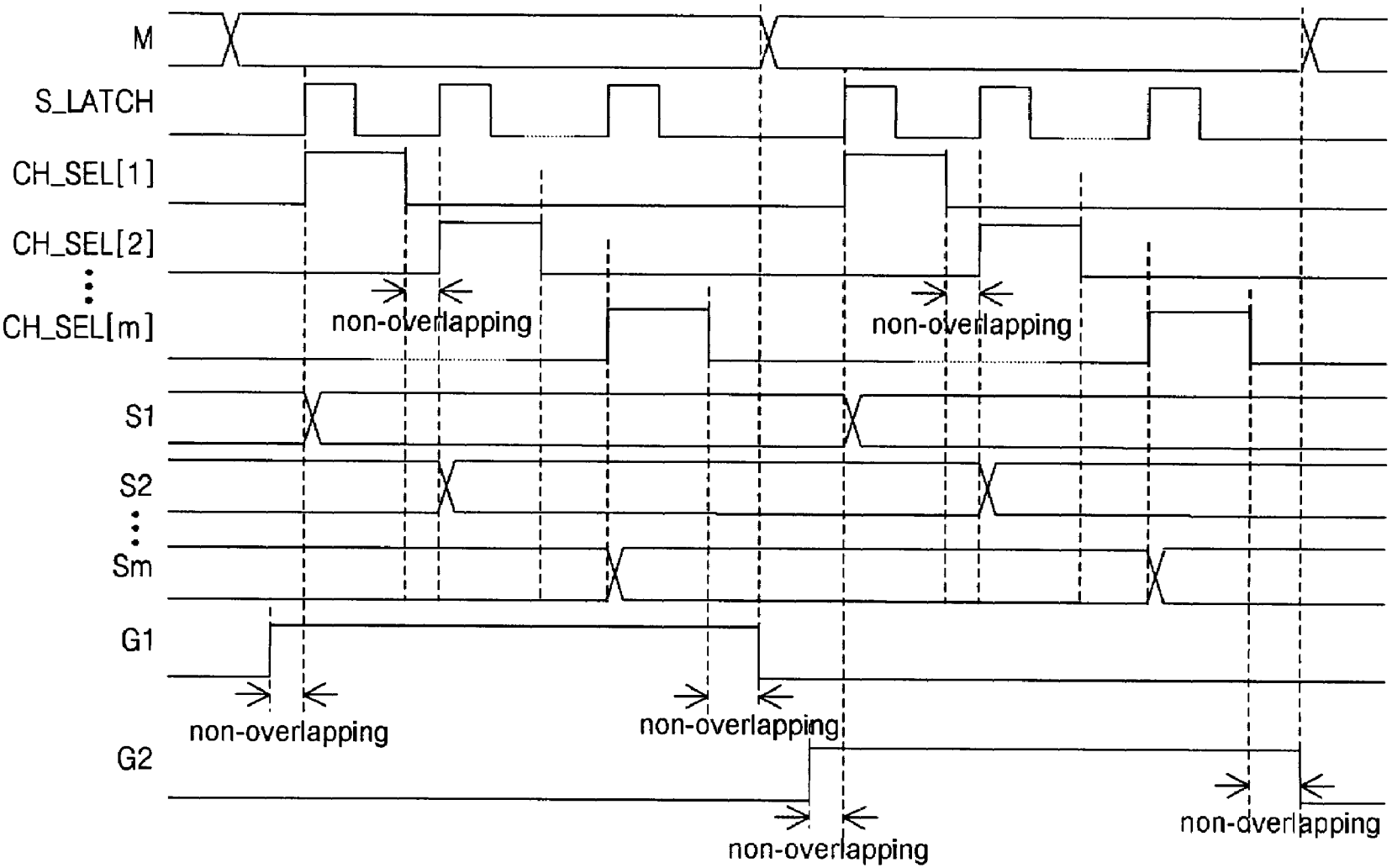
FIG. 5 shows a timing diagram of an operation of the source driver of FIG. 4.

FIG. 4 shows a block diagram of a source driver 400 according to an exemplary embodiment of the present invention. The source driver 400 includes a multiplexer 410, an inversion circuit 420, a latch circuit 430, a gamma decoder 440, a buffer 450, and a channel selection unit 460. The block diagram of FIG. 4 shows a circuit unit for driving m source lines, where m is an integer. To drive a multiple of m source lines, a multiple of the circuit units shown in FIG. 4 may be provided. FIG. 5 shows a timing diagram of the operation of the source driver 400 of FIG. 4.

As is well known in the art, to drive a flat panel display such as a TFT LCD, gate drivers disposed on a flat display panel in the horizontal direction generate scan line drive signals G1 and G2 shown in FIG. 5 which are sequentially activated in a horizontal scan period to drive a plurality of scan lines, and source drivers disposed on the flat display panel in the vertical direction convert three color digital signals, that is, R, G, and B image data input from a controller (not shown) into analog image signals and provide the analog image signals to the source lines to drive the source lines. Pixels in a row selected by the scan line drive signals G1 and G2 store the analog image signals output from the source driver 400 and adjust the brightness by rearranging the liquid crystal molecules in response to the gray voltage levels of the analog image signals.

In the source driver 400 according to an exemplary embodiment of the present invention, the circuit unit shown in FIG. 4 is commonly connected to m source lines, so that the m source lines can be driven in each of the horizontal scan periods. As a result, circuit complexity of the present invention can be reduced substantially by 1/m in comparison to a conventional source driver.

The multiplexer 410 receives image data VD1 to VDm from a controller (not shown) and selects image data VD1 to VDm in response to channel selection signals CH_SEL[1] to CH_SEL[m] generated by the controller. The image data VD1 to VDm is n-bit digital data, for example, 6-bit or 8-bit digital data, wherein n is an integer. As shown in FIG. 5, when each of the scan line drive signals G1 and G2 is activated to a logic high state, the channel selection signals CH_SEL[1] to CH_SEL[m] are sequentially activated to a logic high state. For example, when the first channel selection signal CH_SEL[1] is activated, the multiplexer 410 outputs image data VD1. Similarly, when the second channel selection signal CH_SEL[2] is activated, the multiplexer 410 outputs image data VD2. Finally, when the m-th channel selection signal CH_SEL[m] is activated, the multiplexer 410 outputs image data VDm.

The inversion circuit 420 has a function of selectively inverting the output data of the multiplexer 410 in response to an inversion drive control signal M generated by the controller. More specifically, when the inversion drive control signal M is at a logic high state, the inversion circuit 420 inverts the output data of the multiplexer 410. When the inversion drive control signal M is at a logic low state, the inversion circuit 420 does not invert the output data of the multiplexer 410. As is well known in the art, the object of the inversion operation is to perform a line, column, or field inversion to prevent the liquid crystal from being deteriorated.

The latch circuit 430 stores the output data of the inversion circuit 420 and outputs the stored data in response to a latch control signal S_LATCH generated by the controller. As shown in FIG. 5, when each of the scan line drive signals G1 and G2 is activated to a logic high state, the latch control signal S_LATCH provides pulses, the number of which is equal to the number m of image data VD1 to VDm. In other words, every time the latch control signal S_LATCH is activated to a logic high state, the corresponding channel selection signal CH_SEL[1] to CH_SEL[m] is activated to a logic high state.

The gamma decoder 440 receives analog voltages VG the number of which is determined based on the number n of bits of image data and selects one of the analog voltages VG in response to the output data of the latch circuit 430. The number of determined analog voltages VG is $2^n$, wherein n is the number of bits of image data. The gamma decoder 440, which is a kind of digital-to-analog converter, selects one of the $2^n$ analog voltages VG corresponding to the output data of the latch circuit 430.

The buffer 450 has a function of buffering the selected analog voltage VG. The buffer 450 increases a current drive capacity of the analog voltage VG input from the gamma decoder 440.

The channel selection unit 460 has m switches 461 to 463 to output the buffered analog voltage VG to one of a plurality of channels S1 to Sm in response to the channel selection signals CH_SEL[1] to CH_SEL[m]. For example, when the first channel selection signal CH_SEL[1] is activated, the first switch 461 is activated, so that the channel selection unit 460 can output the buffered analog voltage VG to the first channel S1. Similarly, when the second channel selection signal CH_SEL[2] is activated, the second switch 462 is activated, so that the channel selection unit 460 can output the buffered analog signal VG to the second channel S2. Finally, when the m-th channel selection signal CH_SEL[m] is activated, the m-th switch 463 is activated, so that the channel selection unit 460 can output the buffered analog voltage VG to the m-th channel Sm. As shown in FIG. 5, it is noted that pulses of the channel selection signals CH_SEL[1] to CH_SEL[m] are not overlapped with each other. By doing so, the so-called 'kick-back' phenomenon is prevented. Kick-back is where an image signal of another channel is distorted. For the same reason, it is preferable that after one of the horizontal scan line drive signals G1 and G2 is activated, the transition states of the first and last channel selection signals CH_SEL[1] and CH_SEL[m] not be overlapped with a transition state of one of the horizontal scan line drive signals G1 and G2.

Here, the m channels S1 to Sm are connected to the respective source lines. The source line, input with the buffer analog voltage VG, and the pixel, selected by one of the horizontal scan line drive signals G1 and G2, are rapidly charged. The pixel, input with the analog image signal, adjusts the brightness by rearranging the liquid crystal molecules in response to the corresponding gray voltage levels.

As shown in FIG. 4, the number of channel selection signals CH_SEL[1] to CH_SEL[m] is equal to the number of image data VD1 to VDm, that is, m. In addition, the logical state transition period of each of the channel selection signals CH_SEL[1] to CH_SEL[m] is equal to the horizontal scan period. Image data VD1 to VDm are changed in each of the horizontal scan periods. That is, the controller updates image data VD1 to VDm in each of the horizontal scan periods and inputs the updated image data VD1 to VDm to the multiplexer 410 to drive the next scan line. Next, image data VD1 to VDm updated in each of the horizontal scan periods are selected sequentially by the multiplexer 410 and buffered by the buffer 450, and then, output through the respective channels S1 to Sm in each of the horizontal scan periods. More specifically, when the first channel selection signal CH_SEL[1] is activated, the buffered analog voltage VG corresponding to the corresponding first image data VD1 is output through the corresponding first channel S1 in each of the horizontal scan periods. Similarly, when the second channel selection signal CH_SEL[2] is activated, the buffered analog voltage VG corresponding to the corresponding second image data VD2 is output through the corresponding second channel S2 in each of the horizontal scan periods. Finally, when the last channel selection signal CH_SEL[m] is activated, the buffered analog voltage VG corresponding to the corresponding last image data VDm is output through the corresponding last channel Sm in each of the horizontal scan periods.

Figure 6:
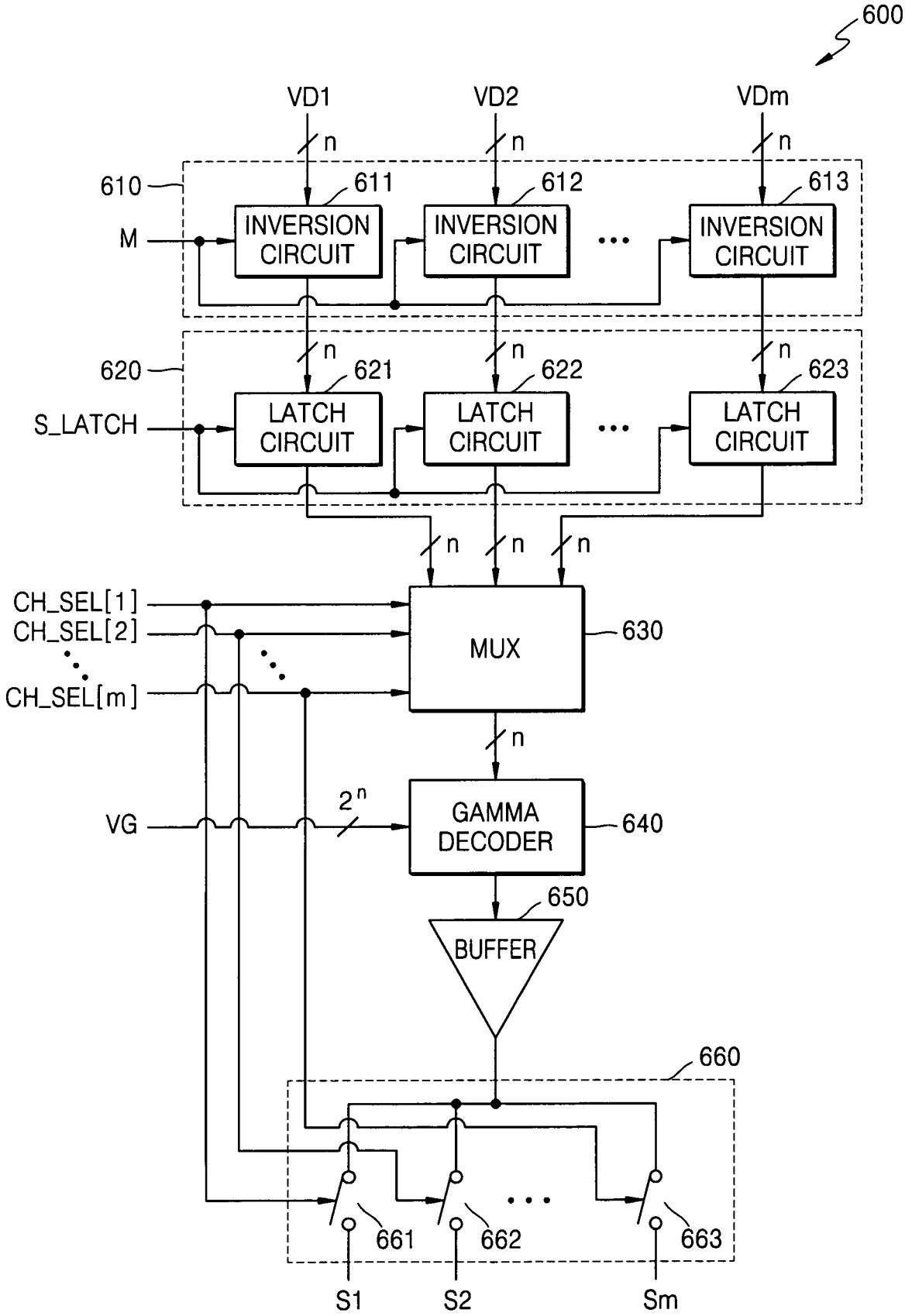
FIG. 6 is a block diagram of a source driver according to another exemplary embodiment of the present invention.
Figure 7:
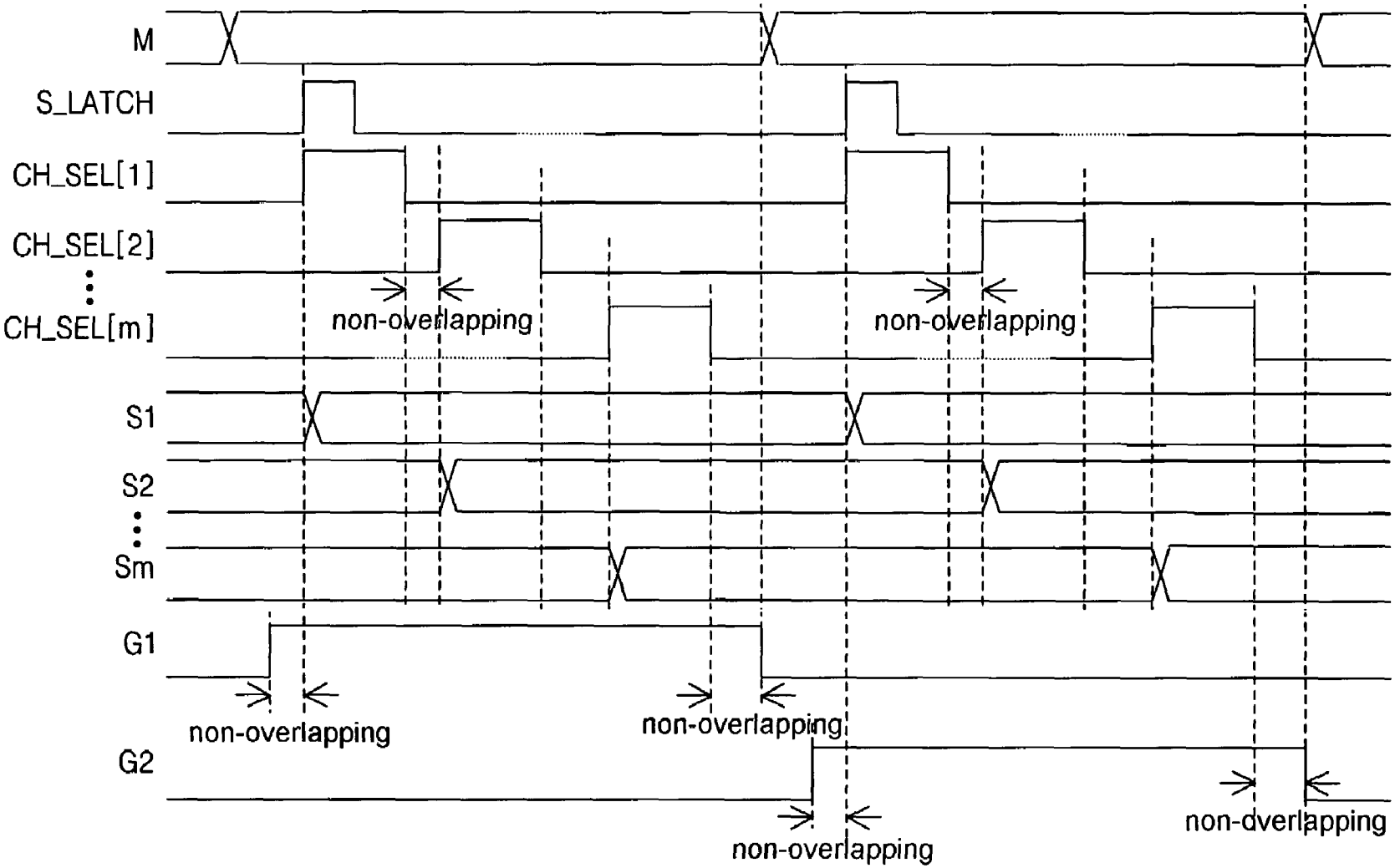
FIG. 7 shows a timing diagram of an operation of the source driver of FIG. 6.

FIG. 6 shows a block diagram of a source driver 600 according to another exemplary embodiment of the present invention. The source driver 600 includes a plurality of inversion circuits 610, a plurality of latch circuits 620, a multiplexer 630, a gamma decoder 640, a buffer 650, and a channel selection unit 660. The block diagram of FIG. 6 shows a circuit unit for driving m source lines, where m is an integer. To drive a multiple of m source lines, a multiple of the circuit units shown in FIG. 6 may be provided. Similarly to FIG. 4, the circuit unit shown in FIG. 6 is commonly connected to m source lines, so that the m source lines can be driven in each of the horizontal scan periods. FIG. 7 shows a timing diagram of the operation of the source driver 600 of FIG. 6.

The inversion circuits 610 include m inversion circuits 611 to 613, each of which receives n-bit image data VD1 to VDm. Each of the inversion circuits 611 to 613 has a function of receiving image data VD1 to VDm and selectively inverting the received image data VD1 to VDm in response to an inversion drive control signal M generated by the controller (not shown) similarly to the inversion circuit 420 shown in FIG. 4.

The latch circuits 620 include m latch circuits 621 to 623. Each of the latch circuits 621 to 623 stores the output data of each of the inversion circuits 611 to 613 and outputs the stored data in response to a latch control signal S_LATCH generated by the controller. The operation of the latch circuits 621 to 623 is different from the operation of the latch circuit 430 shown in FIG. 4. As shown in FIG. 7, when each of the scan line drive signals G1 and G2 is activated to a logic high state, the latch control signal S_LATCH for controlling the latch circuits 621 to 623 has one pulse transitioning from a logic low state to a logic high state.

The multiplexer 630 selects the output data of the latch circuits 621 to 623 in response to channel selection signals CH_SEL[1] to CH_SEL[m] generated by the controller. As shown in FIG. 7, when each of the scan line drive signals G1 and G2 is activated to a logic high state, the channel selection signals CH_SEL[1] to CH_SEL[m] are sequentially activated to a logic high state. For example, when the first channel selection signal CH_SEL[1] is activated, the multiplexer 630 outputs the output data of the first latch circuit 621. Similarly, when the second channel selection signal CH_SEL[2] is activated, the multiplexer 630 outputs the output data of the second latch circuit 622. Finally, when the m-th channel selection signal CH_SEL[m] is activated, the multiplexer 630 outputs the output data of the m-th latch circuit 623.

The gamma decoder 640 receives analog voltages VG the number of which is determined based on the number n of bits of image data and selects one of the analog voltages VG in response to the output data of the multiplexer 630, similarly to the gamma decoder 440 shown in FIG. 4. The number of determined analog voltages VG is $2^n$, wherein n is the number of bits of image data.

The buffer 650 has a function of buffering the selected analog voltage VG. The buffer 650 increases the current drive capacity of the analog voltage VG input from the gamma decoder 640.

The channel selection unit 660 has m switches 661 to 663 to output the buffered analog voltage VG to one of a plurality of channels S1 to Sm in response to the channel selection signals CH_SEL[1] to CH_SEL[m]. More specifically, when the first channel selection signal CH_SEL[1] is activated, the first switch 661 is activated, so that the channel selection unit 660 can output the buffered analog voltage VG to the first channel S1. Similarly, when the second channel selection signal CH_SEL[2] is activated, the second switch 662 is activated, so that the channel selection unit 660 can output the buffered analog signal VG to the second channel S2. Finally, when the m-th channel selection signal CH_SEL[m] is activated, the m-th switch 663 is activated, so that the channel selection unit 660 can output the buffered analog voltage VG to the m-th channel Sm. As shown in FIG. 7, pulses of the channel selection signals CH_SEL[1] to CH_SEL[m] are not overlapped with each other to prevent the so-called 'kick-back' phenomenon. In addition, it is preferable that after one of the horizontal scan line drive signals G1 and G2 is activated, the transition states of the first and last channel selection signals CH_SEL[1] and CH_SEL[m] not be overlapped with a transition state of one of the horizontal scan line drive signals G1 and G2.

In FIG. 6, the m channels S1 to Sm are connected to the respective source lines. The source line, input with the buffer analog voltage VG, and the pixel, selected by the one of the horizontal scan line drive signals G1 and G2, are rapidly charged. The pixel, input with the analog image signal, adjusts the brightness by rearranging the liquid crystal molecules in response to the corresponding gray voltage levels.

As shown in FIG. 7, the number of channel selection signals CH_SEL[1] to CH_SEL[m] is equal to the number of image data VD1 to VDm, that is, m. In addition, the logical state transition period of each of the channel selection signals CH_SEL[1] to CH_SEL[m] and the latch control signal S_LATCH is equal to the horizontal scan period. Image data VD1 to VDm is changed in each of the horizontal scan periods. That is, the controller updates image data VD1 to VDm in each of the horizontal scan periods and inputs the updated image data VD1 to VDm to the inversion circuits 611 to 613 to drive the next scan line. Next, image data VD1 to VDm updated through the inversion circuits 611 to 613 in each of the horizontal scan periods are stored in the latch circuit 621 to 623, multiplexed by the multiplexer 630, buffered by the buffer 650, and then, output through the respective channels S1 to Sm in each of the horizontal scan periods. More specifically, when the first channel selection signal CH_SEL[1] is activated, the buffered analog voltage VG corresponding to the corresponding first image data VD1 is output through the corresponding first channel S1 in each of the horizontal scan periods. Similarly, when the second channel selection signal CH_SEL[2] is activated, the buffered analog voltage VG corresponding to the corresponding second image data VD2 is output through the corresponding second channel S2 in each of the horizontal scan periods. Finally, when the last channel selection signal CH_SEL[m] is activated, the buffered analog voltage VG corresponding to the corresponding last image data VDm is output through the corresponding last channel Sm in each of the horizontal scan periods.

As described above, a circuit unit, including a multiplexer 410 or 630 and a channel selection unit 450 or 660, a source driver 400 or 600 for a flat panel display according to the present invention, performs a single operation to drive one source line in a 1/m segment of a horizontal scan period, and repeats the single operation m times to drive m source lines in the horizontal scan period.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A source driver for driving a flat panel display, comprising:

a multiplexer selecting image data in response to channel selection signals;

an inversion circuit selectively inverting output data of the multiplexer in response to an inversion drive control signal;

a latch circuit storing output data of the inversion circuit and outputting the stored data in response to a latch control signal;

a gamma decoder receiving a plurality of analog voltages, the number of which is determined based on the number of bits of image data and selecting one of the analog voltages in response to the output data of the latch circuit; and a channel section unit outputting the selected analog voltage to one of a plurality of channels in response to the channel selection signals, wherein each of the selected analog voltages corresponding to the image data is output to the corresponding channel in one horizontal scan period;

wherein the source driver further includes a buffer which is configured to buffer the selected analog voltage, and the buffer is connected between the gamma decoder and the channel selection unit and commonly connected to the plurality of channels through the channel selection unit;

wherein the channel selection unit includes a plurality of switches which are configured to connect an output of the buffer to the plurality of channels, and wherein the latch control signal provides pulses, the number of which is equal to the number of channels of image data supplied to the multiplexer in the horizontal scan period.

2. The source driver according to claim 1, wherein the number of channel selection signals is equal to the number of channels of image data.

3. The source driver according to claim 1, wherein the number of determined analog voltages is $2^n$, and wherein n is the number of bits of image data.

4. The source driver according to claim 1, wherein a logical state transition period of each of the channel selection signals is equal to the horizontal scan period, and wherein image data is changed in the horizontal scan periods.

5. The source driver according to claim 1, wherein transition states of pulses of the channel selection signals are not overlapped with each other, and wherein after a horizontal scan line drive signal is activated, the transition states of the first and last channel selection signals are not overlapped with a transition state of the horizontal scan line drive signal.

6. A method of driving a flat panel display, comprising:

receiving image data;

selecting image data in response to channel selection signals;

receiving analog voltages;

selecting analog voltages corresponding to the image data; and outputting the analog voltages to channels in response to the channel selection signals, wherein the analog voltages corresponding to the image data are output to the corresponding channel in one horizontal scan period, and wherein the channels drive the corresponding source lines of the flat panel display;

wherein selecting image data in response to channel selection signals further comprises:

selectively inverting the image data in response to an inversion drive control sirgnal;

storing the image data; and outputting the image data in response to a latch control signal;

buffering the selected analog voltage; and outputting the buffered analog voltages to channels in response to the channel selection signals, and wherein the latch control signal provides pulses, the number of which is equal to the number of channels of image data supplied to the multiplexer in the horizontal scan period.

7. The method according to claim 6, wherein of each of the channel selection signals is equal to the horizontal scan period, wherein each of the image data is changed in each of the horizontal scan periods, and wherein the latch control ignals has pulses, the number of which is equal to the number of channels of image data supplied to the multiplexer in the horizontal scan period.

8. The method according to claim 6, wherein transition states of pulses of the channel selection signals are not overlapped with each other, and wherein, after a horizontal scan line drive signal is activated, the transition states of first and last channel selection signals are not overlapped with a transition state of the horizontal scan line drive signal.

* * * * *